US005214837A

United States Patent [19]

Stafford

[11] Patent Number: 5,214,837

[45] Date of Patent: Jun. 1, 1993

[54] AUTOMATIC RIVETING NUTPLATE INSTALLATION DEVICE AND METHOD OF RIVETING A NUTPLATE TO A WORKPIECE

[75] Inventor: Donald E. Stafford, Escondido, Calif.

[73] Assignee: Teledyne Ryan Aeronautical, Division of Teledyne Industries, Inc., San Diego, Calif.

[21] Appl. No.: 787,687

[22] Filed: Nov. 4, 1991

[51] Int. Cl.[5] ..... B23P 11/02; B23P 11/00

[52] U.S. Cl. ..... 29/525.2; 29/243.53; 29/243.54; 29/34 B

[58] Field of Search ..... 29/238, 243.53, 243.54, 29/525.2, 34 B; 227/27, 67, 58

[56] References Cited

U.S. PATENT DOCUMENTS

| | | | |
|---|---|---|---|
| 3,646,660 | 3/1972 | Sheffer, Jr. | 29/243.53 |
| 3,729,809 | 5/1973 | Vawter et al. | 29/243.53 |
| 4,578,846 | 4/1986 | Schott et al. | 29/243.53 |
| 4,930,206 | 6/1990 | Suzuki et al. | 29/243.54 |

*Primary Examiner*—P. W. Echols
*Assistant Examiner*—David P. Bryant
*Attorney, Agent, or Firm*—Brown, Martin, Haller & McClain

[57] ABSTRACT

A device for aligning and supporting a nutplate against the workpiece to which it is to be fastened during the entire fastening cycle of an automatic riveting machine. The device has a base that may be mounted on the lower ram of an automatic riveting machine. A nutplate elevator moves vertically within a sleeve extending upwardly from the base. The end of the sleeve supports the workpiece lower surface. A driver anvil has pins that may be forced against the rivet tails in response to motion of the lower ram driving pin.

In operation, the lower ram rises, clamping the workpiece between the end of the sleeve and the upper pressure foot. The nutplate elevator is lowered by applying air pressure to the top of a piston, which is contained within the anvil. A nutplate is placed on the elevator. The nutplate is raised by applying air pressure to the bottom of the piston, forcing the nutplate against the workpiece. The automatic riveting machine is programmed to drill a number of holes corresponding to the number of rivet holes in the nutplate being fastened. The riveting machine then executes a normal riveting cycle, drilling holes in the workpiece and installing rivets in the holes. The nutplate installation device may include one or more compressed air supply tubes directed towards the rivet holes for clearing debris from the holes during drilling.

12 Claims, 4 Drawing Sheets

AUTOMATIC RIVETING NUTPLATE INSTALLATION DEVICE AND METHOD OF RIVETING A NUTPLATE TO A WORKPIECE

BACKGROUND OF THE INVENTION

The present invention relates generally to a riveting machine attachment for indexing and supporting a part to be riveted to a workpiece in an automatic riveting machine and, more specifically, to an attachment for indexing and supporting a nutplate during installation of the nutplate on the workpiece.

Automatic riveting machines, such as those manufactured by ITC Automation ("ITC") of Dayton, Ohio can perform the repetitive steps of drilling one or two holes in a workpiece, feeding one or two solid rivets to the rivet installation head, and installing the rivets in the holes. In the ITC machine, the riveting head and the drilling head are mounted on a reciprocating shuttle, which alternately moves the riveting head and the drilling head to a "Work" position at a point above the workpiece upper surface where the rivets are to be installed.

In each fastening cycle, one or two solid rivets are automatically injected into the riveting head rivet support fingers through a feed tube at a "Load" position. The rivets are held in the support fingers with the rivet heads in contact with the riveting head upper anvil and the rivet tails extending downward. At the Work position, the workpiece upper surface is in contact with an upper pressure foot and the workpiece lower surface is in contact with a lower anvil clamping sleeve. The lower anvil tool is mounted on the riveting machine lower ram, which is adjusted to clamp the workpiece between the upper pressure foot and the lower anvil tool. The drilling head, then at the Work position, descends through an opening in the upper pressure foot and drills a hole in the workpiece. The shuttle then moves the riveting head to the Work position, moving the drilling head out of the way. The riveting head lowers the rivet stem into the hole. Next, the riveting machine lower ram driving pin moves upward through an opening in the lower anvil clamping sleeve to upset the rivet tail, thereby forming the "bucktail" that secures the rivet to the workpiece. The lower ram driver pin then retracts downward and the shuttle moves the drilling head into position to begin the next fastening cycle.

Engineering specifications often require nutplates to be riveted to a workpiece. A nutplate is a well-known part that has a threaded barrel extending therefrom for receiving a threaded shaft or bolt, and one or more holes through which rivets are inserted for fastening the nutplate to a workpiece. Nutplates are commonly manually riveted to a workpiece because of the lack of a suitable automatic nutplate installation attachment for most automatic riveting machines. However, ITC Automation has produced and sold a nutplate fastening device that can be attached to its automatic riveting machines.

Although the ITC attachment increases nutplate installation speed, its use is restricted to substantially flat workpieces. Nutplates are delivered automatically from a vibratory bowl feeder and are received in a "catching chamber" via a feed tube. The catching chamber and attached feed tube form a wide and bulky structure that interferes with workpieces having curved surfaces, or workpieces having perturbations or additional parts extending from the workpiece lower surface.

Furthermore, the ITC attachment produces an unacceptably high number of out-of-tolerance assemblies. After the drilling operation, the ITC attachment aligns the nutplate rivet holes with the holes in the workpiece at an intermediate location, between the Load position and the Work position, and then installs the rivets. The drilling operation often leaves exit burrs around the holes, which prevent the nutplate from lying flush on the workpiece surface during riveting. Nutplates standing off from the workpiece surface often exceed allowable manufacturing tolerances and must be removed and replaced.

Practitioners in the art of automatic fastening have long known that numerous problems, including that of exit burrs wedged between parts to be fastened, can be avoided by aligning and clamping the parts together prior to drilling. However, this principle has not been applied to the fastening of a nutplate to a workpiece in an automatic riveting machine.

The ITC attachment may occasionally damage the workpiece. A nutplate may lodge in the catching chamber in a "tipped" or cocked position. The workpiece may be fractured or dented when the lower ram presses the tipped nutplate against the workpiece lower surface. The catching chamber of the ITC nutplate attachment completely encloses the nutplate, preventing an operator from noticing the tipped condition of the nutplate and correcting it.

An automatic nutplate installation device that can install nutplates on curved or irregular assemblies would greatly increase manufacturing efficiency. In addition, such a device should precisely locate and align the nutplate in its intended position throughout the fastening machine cycle and in full view of the operator.

These problems and deficiencies are clearly felt in the art and are solved by the present invention in the manner described below.

SUMMARY OF THE INVENTION

The present invention is a device for aligning and supporting a nutplate against the workpiece during the entire fastening cycle of an automatic riveting machine. The device may be mounted on the lower ram of an existing automatic riveting machine or may be incorporated into a machine specifically designed for fastening nutplates.

The device comprises a base, which may be mounted on the lower ram of a riveting machine, and a nutplate elevator that moves vertically within a sleeve extending upwardly from the base. The end of the sleeve supports the workpiece lower surface and serves as a clamping surface.

A hollow casing connects the sleeve to the base. A driver anvil is slidably disposed within the casing. A driven plug for transmitting the motion of the lower ram driving pin to the driver anvil extends through a hole in the base.

An elevator piston and elevator driving stem are disposed within a chamber in the driver anvil. Two air inlets, one on either side of the elevator piston, provide air pressure for moving the elevator in two directions.

One or more rivet tail upset drivers are also disposed within bores in the driver anvil. The lower ends of the rivet tail upset drivers contact the driver anvil at the bottom of their respective bores. The upper ends of the rivet tail upset drivers extend beyond the end of the driver anvil and contact the rivet tails when forced upward in response to upward motion of the lower ram driving pin transmitted through the driver anvil. The driver anvil has a spring-loaded return.

A nutplate locator pin for engaging the threaded hole in the nutplate is disposed within the elevator for positively locating the nutplate and seating it on the elevator. The locator pin eliminates the possibility that a nutplate will be in a tipped position when it contacts the workpiece.

The riveting machine upper anvil, which normally carries a single rivet, may be interchanged to carry a greater number of rivets if the nutplate being fastened has more than one rivet hole. The riveting machine rivet feed tube and support fingers may be similarly interchanged. The most frequently specified nutplates have either one or two rivet holes. These modifications allow the riveting head to install more than one rivet simultaneously. Such changes are easily accomplished by a person of ordinary skill in the art. It may be possible to avoid modifying some riveting machines with which the present invention may be used by programming the machine to install a plurality of rivets in successive fastening cycles.

In operation, the lower ram rises, bringing the end of the sleeve into contact with the workpiece lower surface. The workpiece remains clamped between the sleeve end and the upper pressure foot. The narrow sleeve can easily extend into concave areas in the workpiece lower surface. Curved workpieces can be accommodated as well. Air pressure is applied to the upper air inlet, which lowers the nutplate elevator. An operator places a nutplate on a nutplate elevator. Air pressure is then applied to the lower air inlet, which raises the elevator. The elevator brings the nutplate into contact with the workpiece lower surface.

The automatic riveting machine is programmed to drill a number of holes corresponding to the number of rivet holes in the nutplate being fastened. The riveting machine then executes a normal riveting cycle. For example, if the nutplate has two holes, the drilling head drills the first hole through the workpiece and nutplate first rivet hole. The drilling head moves laterally by a distance of the nutplate rivet hole spread dimension. The drilling head then drills the second hole through the workpiece and the nutplate second rivet hole. The nutplate installation device may include one or more compressed air supply tubes directed towards the rivet holes for clearing debris from the holes during drilling.

The riveting head, having picked up two rivets in dual upper anvils, then moves to the work position. The lower ram driving pin moves upward, forcing the driver anvil and the two rivet tail upset drivers upward. The end of each rivet tail upset driver contacts the rivet with which it is aligned, forming a bucktail. The return spring urges the driver anvil downward when the lower ram driving pin ceases to apply force. The lower ram then retracts downward, allowing the workpiece to be repositioned for the next fastening cycle.

BRIEF DESCRIPTION OF THE DRAWINGS

The foregoing, together with other features and advantages of the present invention will become more apparent when referring to the following detailed description in which reference numerals refer to the drawings in which.

DESCRIPTION OF THE PREFERRED EMBODIMENTS

Figures 1, 2:
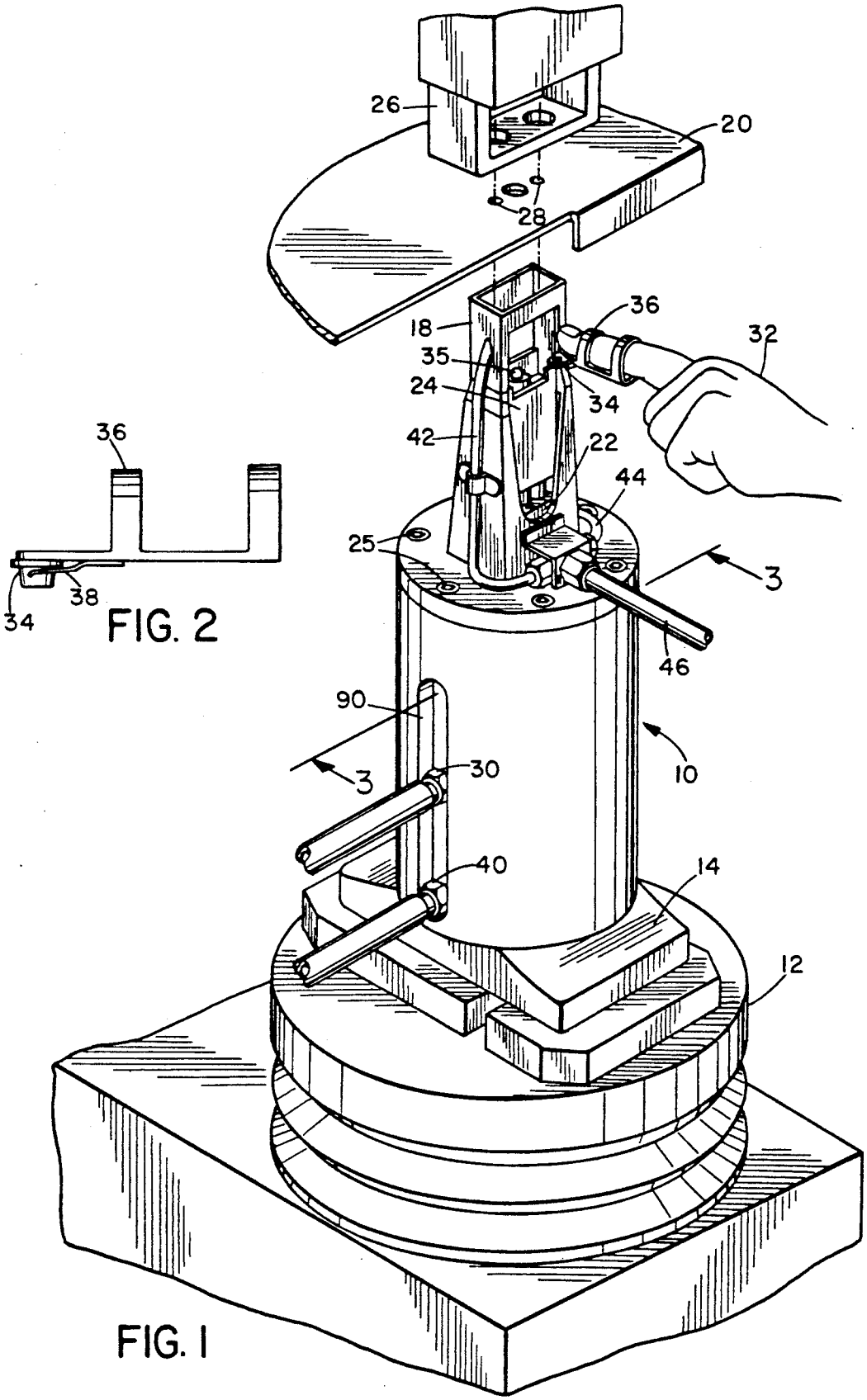
FIG. 1 is a perspective view illustrating the apparatus in position for loading a nutplate.
FIG. 2 is a side elevation view of a suitable finger grip for holding a nut plate for loading.

Referring to FIG. 1, the automatic nutplate riveting attachment of the present invention comprises a housing 10 mounted on the lower ram 12 of an automatic riveting machine (not shown). The automatic riveting machine is not part of the present invention. Housing 10 comprises a base 14 mounted on lower ram 12, a cylindrical casing 16, and an elevator sleeve 18. The end of sleeve 18 contacts the lower surface of the workpiece 20 to be riveted. A driver anvil 22 slides vertically within casing 16 and sleeve 18. A nutplate elevator 24 slides vertically within sleeve 18. Cap screws 25 connect sleeve 18 to casing 16.

In operation, the workpiece is positioned beneath the upper pressure foot 26 of the automatic riveting machine. Lower ram 12 is raised until the workpiece is securely clamped between the end of sleeve 18 and upper pressure foot 26. Compressed air is then applied to the upper air inlet 30, lowering nutplate elevator 24 to the position at which it is shown in FIGS. 1, 3, 9 and 10. The mechanism for raising and lowering nutplate elevator 24 is discussed below. An operator 24 then places a nutplate 34 on elevator 24. A nutplate locator pin 35, best illustrated in FIGS. 9 and 10, engages the hole (not shown) in the nutplate barrel to positively seat nutplate 34 on elevator 24. Nutplate locator pin 35 extends into a hole in the top of elevator 24 and is retained by a set screw 37 that contacts a flat area 39 of nutplate locator pin 35.

Although the operator may use bare fingers or other means to load nutplate 34, the use of a nutplate applicator 36 is preferred. Nutplate applicator 36, shown in greater detail in FIG. 2, fits on the operator's finger and has a magnet 38 for retaining the nutplate. The use of applicator 36 increases operator safety and placement accuracy by not obscuring the operator's view of nutplate 34 and elevator 24 during loading.

Figure 7:
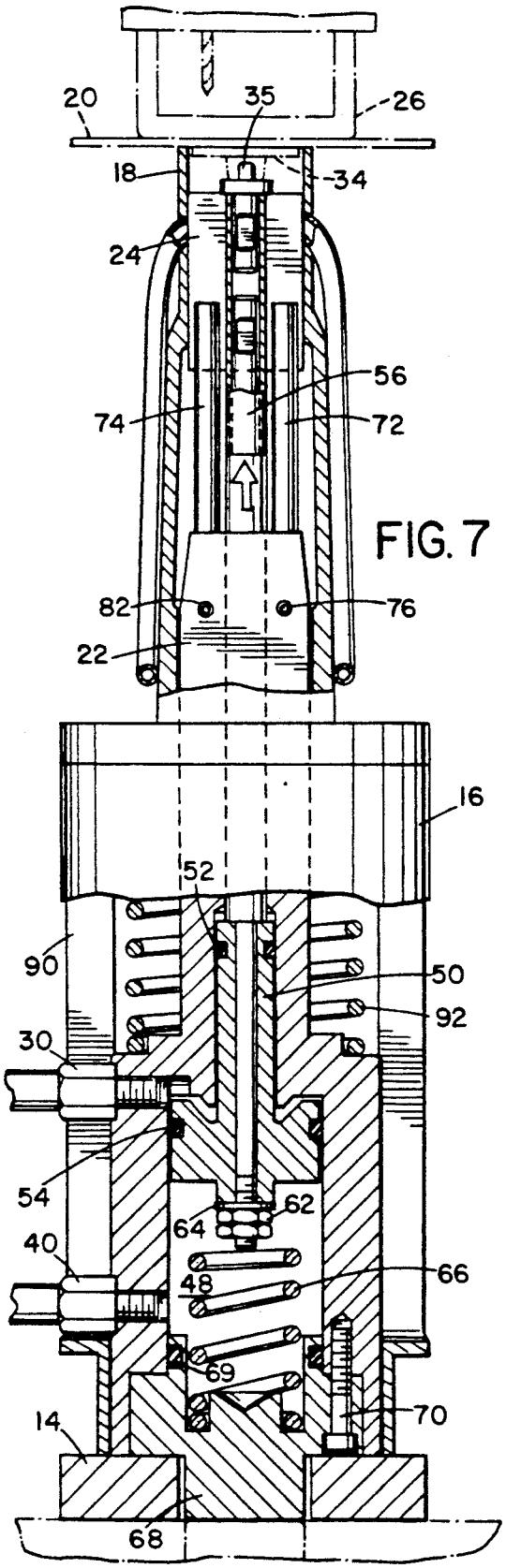
FIG. 7 is a view similar to FIG. 3 showing the nut plate elevated to the workpiece.
Figure 12:
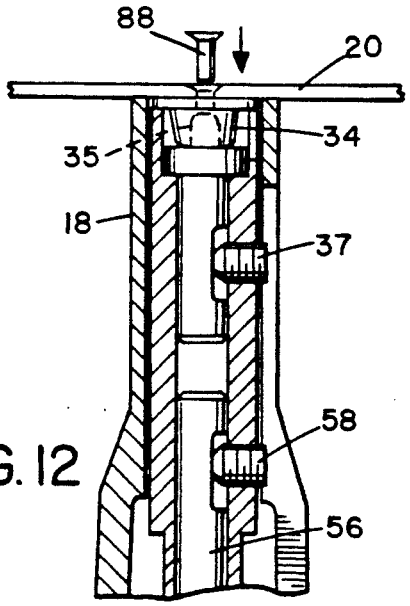
FIG. 12 is a view similar to a portion of FIG. 10 showing the nut plate elevated to the workpiece.

After nutplate loading, compressed air is applied to the lower air inlet 40, raising nutplate elevator 24 to the position at which it is shown in FIGS. 7 and 12. While nutplate 34 is clamped against workpiece 20, the automatic riveting machine drills rivet holes 28 in workpiece 20. Chips and debris from the drilling operation are dispersed by two blower tubes 42 and 44 that receive compressed air from a blower air inlet 46.

Figure 3:
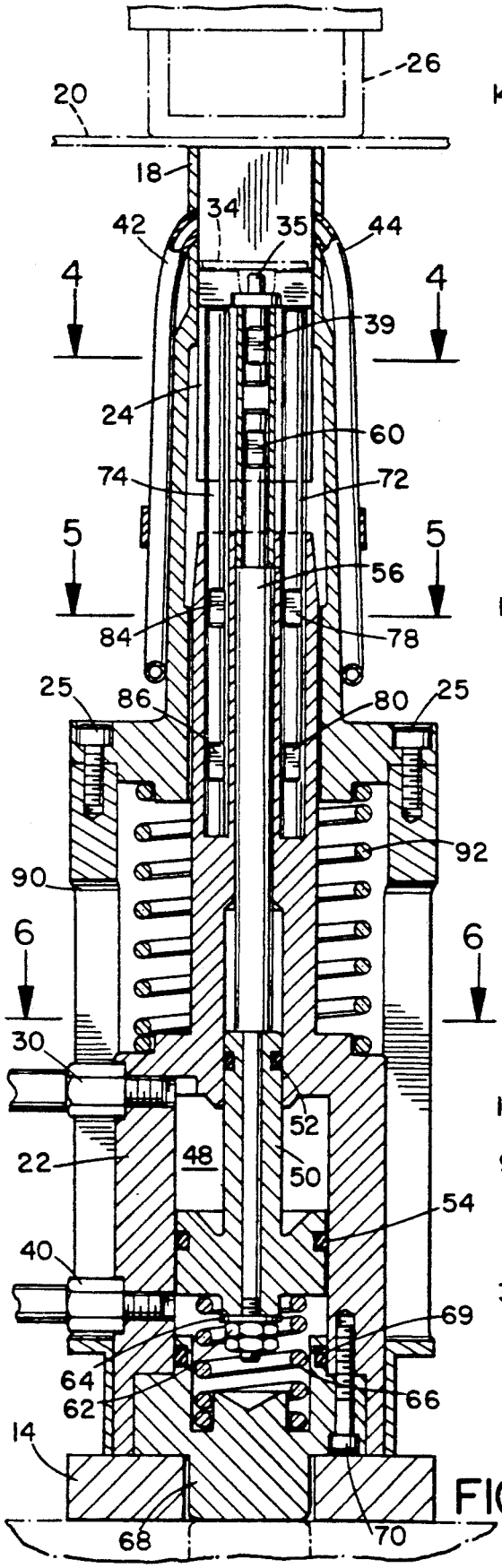
FIG. 3 is an enlarged sectional view taken along line 3—3 of FIG. 1.

The nutplate elevator assembly comprises a mechanism for raising and lowering nutplate elevator 24, as shown in FIGS. 3 and 7. Driver anvil 22 has an upper portion extending into sleeve 18 and a cylindrical lower portion having a piston chamber 48. An elevator piston 50 having a narrow upper portion and a wide lower portion is disposed within piston chamber 48. Resilient O-ring 52 seals the upper portion of piston 50 against the wall of piston chamber 48 and resilient O-ring 54 seals the lower portion of piston 50 against the wall of piston chamber 48. When compressed air is applied to lower air inlet 40 below the wide portion of piston 50, piston 50 is forced upwards (as indicated by the arrow in FIG. 7) to the position at which it is shown in FIG. 7. The air above the wide portion of piston 50 is forced out of piston chamber 48 through upper air inlet 30. When compressed air is applied to upper air inlet 30 above the wide portion of piston 50, piston 50 is forced downwards to the position shown in FIG. 3. The air below the wide portion of piston 50 is forced out of piston chamber 48 through lower air inlet 40.

The motion of piston 50 is transmitted to elevator 24 through an elevator driving stem 56. The upper end of driving stem 56 extends into the hole in the bottom of nutplate elevator 24 and is retained by a set screw 58 that contacts a flat area 60 of driving stem 56. The lower end of driving stem 56 is threaded and extends through a hole in piston 50, where it is retained by the combination of nuts 62 and washer 64. A cushioning spring 66 is disposed below the wide portion of piston 50 for cushioning the piston downstroke, thereby preventing excessive wear and noise.

In FIG. 7, nutplate 34 is shown clamped against workpiece 20 by elevator 24. The device is ready to install the rivets after the drilling operation is complete. A driven plug 68 is disposed at the bottom of chamber 48 and has a portion that extends through a hole in base 14. Driven plug 68 is attached to driver anvil 22 with cap screw 70 and transmits the upward motion of the lower ram driving pin (shown in phantom lines) to the anvil assembly. A resilient O-ring 69 around driven plug 68 seals chamber 48 below piston 50.

Figure 4:
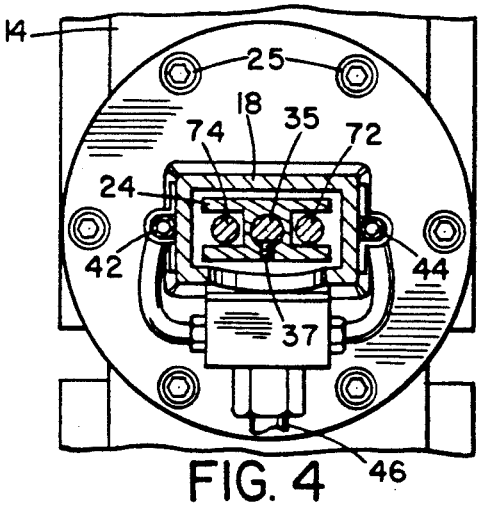
FIG. 4 is a sectional view taken along line 4–4 of FIG. 3.
Figure 5:
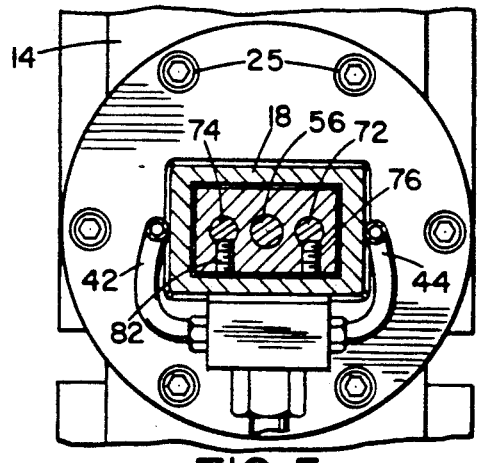
FIG. 5 is a sectional view taken along line 5–5 of FIG. 3.
Figure 6:
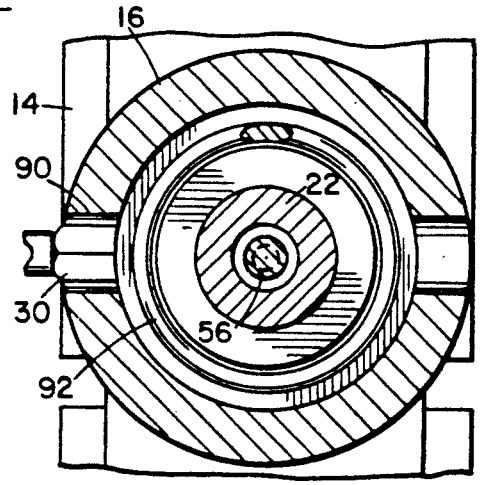
FIG. 6 is a sectional view taken along line 6—6 of FIG. 3.

The upward motion of driver anvil 22 is, in turn, transmitted to two rivet tail upset drivers 72 and 74, which are disposed within bores in driver anvil 22, as shown in FIGS. 3–5. Dual upset drivers are preferred to allow installation of nutplates having two rivet holes. The lower ends of the rivet tail upset drivers 72 and 74 contact driver anvil 22 at the bottom of their respective bores. Rivet tail upset driver 72 is retained in driver anvil 22 with set screws 76 and 77 that contact flat areas 78 and 80 respectively of rivet tail upset driver 72. Similarly, rivet tail upset driver 74 is retained in driver anvil 22 with set screws 82 and 83 that contact flat areas 84 and 86 respectively of rivet tail upset driver 74. The upper ends of rivet tail upset drivers 72 and 74 extend beyond the upper end of driver anvil 22 and through nutplate elevator 24 on either side of nutplate locator pin 35.

Figure 8:
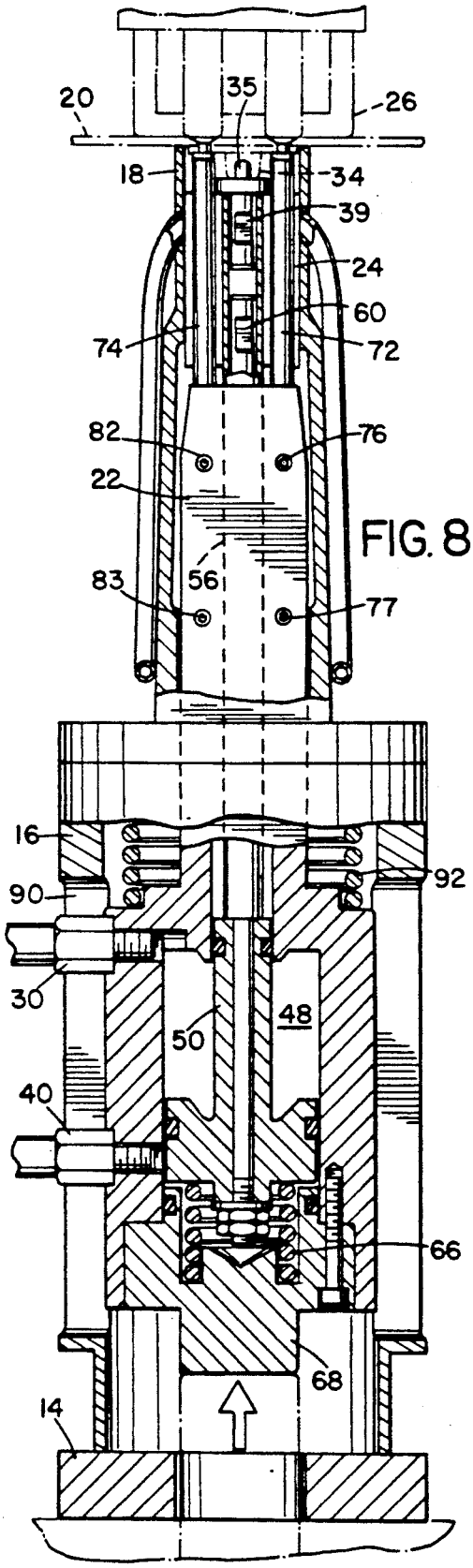
FIG. 8 is a view similar to FIG. 7 showing the nutplate being riveted to the workpiece.
Figure 9:
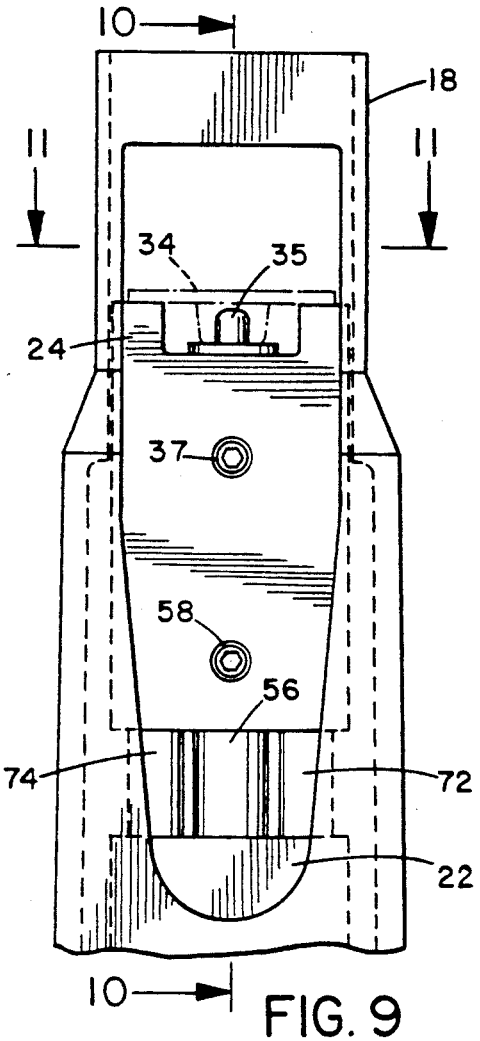
FIG. 9 is an enlarged front view of the top portion of the present invention.
Figure 10:
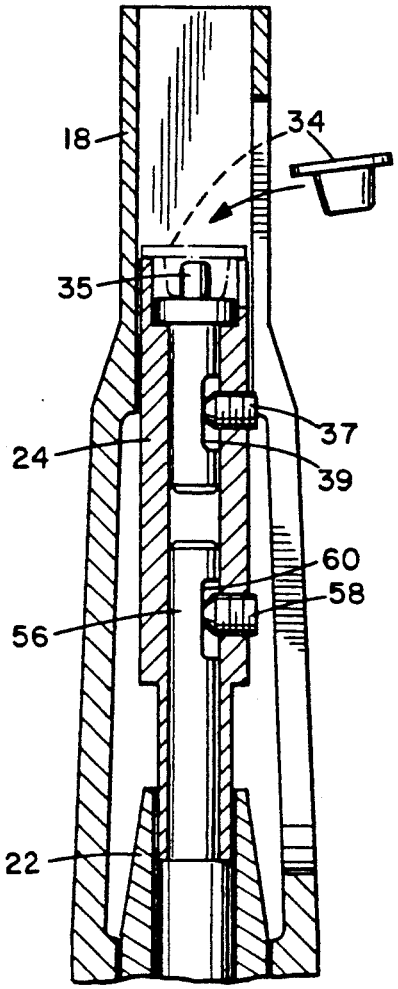
FIG. 10 is a sectional view taken along line 10—10 of FIG. 9.
Figure 11:
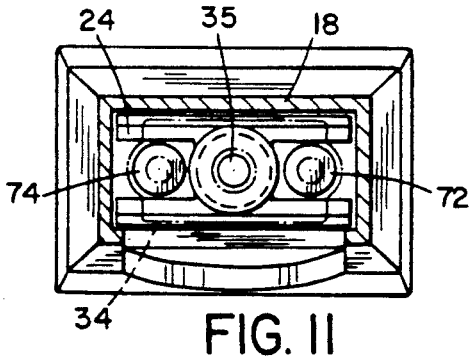
FIG. 11 is a sectional view taken along line 11—11 of FIG. 9.

To install the rivets, the automatic riveting machine riveting head deposits rivets 88 into holes 28 previously drilled in workpiece 20 while clamped to nutplate 34, as shown in FIG. 12. The automatic riveting machine lower ram driving pin then moves upwards, as shown by the arrow in FIG. 8, transmitting the force to driver anvil 22 and rivet tail upset drivers 72 and 74. The upper ends of rivet tail upset drivers contact the rivet tails that extend through the holes in workpiece 20. This force upsets the rivet tails, thereby forming the rivet bucktails that fasten nutplate 34 to workpiece 20. The upward force transmitted through cushioning spring 66 maintains nutplate 34 clamped securely against workpiece 20 during riveting. Air inlets 30 and 40, which are attached to driver anvil 22, freely move vertically with driver anvil 22 along a slot 90 in casing 16 through which they extend.

The automatic riveting machine lower ram driving pin then retracts downward. A return spring 92, which was compressed by the upward motion of driver anvil 22, forces driver anvil 22 and rivet tail upset drivers 72 and 74 downward and away from the fastened nutplate. The fastening cycle can then be repeated to install additional nutplates.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. A nutplate installation apparatus for receiving and supporting a nutplate, said nutplate having at least one rivet hole for receiving a rivet, comprising:

a base having an opening;

a hollow casing having a first end attached to said base and a second end extending perpendicularly from said base;

a sleeve having a first end attached to said second end of said casing, said sleeve having a second end for contacting said workpiece;

a driver anvil having a cylindrical portion for slidably moving within said casing, a narrow portion having an end extending into said sleeve, a hollow piston chamber within said cylindrical portion, and a hollow stem shaft extending from said piston chamber through said narrow portion of said driver anvil;

at least one rivet tail upset driver having a first end attached to said driver anvil and a second end extending from said end of said narrow portion of said driver anvil for applying a force to each said rivet;

an elevator piston disposed within said piston chamber;

an elevator driving stem having a first end attached to said elevator piston and a second end extending through said stem shaft; and a nutplate elevator attached to said second end of said elevator driving stem for receiving a nutplate and for moving said nutplate into contact with said workpiece.

2. A nutplate installation apparatus as described in claim 1, wherein:

said narrow portion of said driver anvil has a hollow upset driver shaft corresponding to each said rivet tail upset driver; and said first end of each said rivet tail upset driver is disposed within each said upset driver shaft.

3. A nutplate installation apparatus as described in claim 2, wherein said anvil assembly further comprises:

a plurality of set-screws mounted in said narrow portion of said driver anvil for retaining said rivet tail upset drivers in said upset driver shafts.

4. A nutplate installation apparatus as described in claim 1, wherein:

said casing has a longitudinal slot; and said driver anvil has an upper air inlet and a lower air inlet, said upper air inlet mounted on said driver anvil between said elevator piston and said sleeve and extending through said longitudinal slot, and said lower air inlet mounted on said driver anvil between said elevator piston and said base and extending through said longitudinal slot.

5. A nutplate installation apparatus as described in claim 4, further comprising:

a nutplate locator pin mounted on said nutplate elevator.

6. A nutplate installation apparatus as described in claim 5, further comprising:

a return spring bearing against said sleeve and said driver anvil for biasing said driver anvil in a direction away from said workpiece.

7. A nutplate installation apparatus as described in claim 6, further comprising:

a driven plug attached to said driver anvil and having a portion disposed within said opening in said base.

8. A nutplate installation apparatus as described in claim 7, further comprising:

a cushioning spring disposed between said driven plug and said elevator piston.

9. A nutplate installation apparatus as described in claim 8, further comprising:

at least one chip blower tube rigidly mounted relative to said sleeve.

10. A nutplate installation apparatus as described in claim 9, further comprising:

at least one resilient O-ring disposed on said driven plug.

11. A nutplate installation apparatus as described in claim 10, further comprising:

at least one resilient O-ring disposed on said elevator piston.

12. A method for riveting a nutplate to a workpiece having top and bottom surfaces in an automatic riveting machine having a hollow casing, a sleeve mounted on an end of said casing, an anvil having a piston chamber with a piston slidably disposed therein, said anvil slidably disposed within said casing, and a nutplate elevator connected to said piston and slidably disposed within said sleeve, comprising the steps of:

moving said sleeve into contact with said workpiece bottom surface;

moving said piston relative to said anvil while said anvil remains stationary relative to said casing until said nutplate elevator is at a first position spaced from said workpiece bottom surface;

disposing a nutplate having at least one rivet hole on said nutplate elevator;

moving said piston relative to said anvil while said anvil remains stationary relative to said casing until said nutplate elevator is at a second position adjacent to said workpiece, said nutplate being in contact with said workpiece bottom surface at said second position;

drilling at least one hole through said workpiece from said top surface through said bottom surface, each said hole aligned with each said rivet hole of said nutplate;

placing a rivet into each said hole from said top surface, said placed rivet having a rivet head bearing against said workpiece top surface and a rivet tail protruding from said workpiece bottom surface; and moving said anvil relative to said casing while said piston remains stationary relative to said casing until said anvil is forced against each said rivet tail simultaneously, thereby forming a bucktail on each said rivet tail.

* * * * *